US011858593B2

(12) United States Patent
Freire et al.

(10) Patent No.: US 11,858,593 B2
(45) Date of Patent: Jan. 2, 2024

(54) SELF-RETRIEVING ANCHOR (SRA)

(71) Applicant: Sardine Marine, LLC, Medley, FL (US)

(72) Inventors: Jose Manuel Freire, Medley, FL (US); Jose Guggenheim, Medley, FL (US)

(73) Assignee: Sardine Marine, LLC, Medley, FL (US)

( * ) Notice: Subject to any disclaimer, the term of this patent is extended or adjusted under 35 U.S.C. 154(b) by 215 days.

(21) Appl. No.: 17/487,684

(22) Filed: Sep. 28, 2021

(65) Prior Publication Data

US 2023/0099887 A1 Mar. 30, 2023

(51) Int. Cl.
*B63B 21/24* (2006.01)
*B63B 21/26* (2006.01)

(52) U.S. Cl.
CPC ..... *B63B 21/243* (2013.01); *B63B 21/26* (2013.01); *B63B 2021/246* (2013.01)

(58) Field of Classification Search
CPC ..... B63B 21/24; B63B 21/243; B63B 21/26; B63B 2021/246; B63B 21/38; B63B 21/42; B63B 21/50
USPC ..... 114/294, 297
See application file for complete search history.

(56) References Cited

U.S. PATENT DOCUMENTS 3,485,199 A 12/1969 Schuman
4,708,086 A 11/1987 Brown, Jr.
4,823,721 A * 4/1989 Pekny ..... B63B 21/243 114/302
4,926,779 A * 5/1990 Piton ..... B63B 21/44 114/298
5,474,015 A * 12/1995 Bruce ..... B63B 21/46 114/304
7,886,681 B2 2/2011 Weinstein et al.
8,485,117 B2 7/2013 Weinstein et al.
8,667,919 B2 3/2014 Higby

FOREIGN PATENT DOCUMENTS

JP 4361558 B2 11/2009

* cited by examiner

*Primary Examiner* — Daniel V Venne
(74) *Attorney, Agent, or Firm* — Lerner David LLP

(57) ABSTRACT

A self-retrievable anchor with a shovel, lever, and manifold contains no welded parts eliminating weld failure due to tensional and bending forces during anchor retrieval. The anchor has interchangeable parts. The manifold attaches the shovel to lever, and contains at least an internal breakable fuse. A specific dimensioned fuse to anchor size is used. The fuse is not universal. When a tensional force is applied above fuse shear strength capacity, and below breaking strength of the rope, the fuse breaks rotating the shovel 180° about a pivot hinge pin. The anchor is released when stuck at sea bottom without any loss. The anchor's interchangeable parts makes it capable to change shovel shapes suitable to different sea bottom conditions. A stop bar on the shovel portion may be included. The lever may also detach during retrieval by a breakable pivot hinge pin or fuse pin alone, and shovel/manifold later replaced.

20 Claims, 5 Drawing Sheets

SELF-RETRIEVING ANCHOR (SRA)

FIELD OF USE

The present application relates to the field of marine anchor apparatus and methods to facilitate retrieval of an anchor lodged in an underwater obstruction that cannot be retrieved by conventional methods. Specifically, the present application discloses a self-retrievable anchor. The anchor has an interchangeable shovel to adapt to various underwater conditions. There are no welds in the self-retrievable anchor to avoid material failure from welding marks. A specific fuse pin sized to the specific anchor used assists in the retrieval.

BACKGROUND OF THE INVENTION

Marine anchors are widely used to secure marine vessels at a location on a body of water. Generally anchors are constructed from metal and parts of the anchor are welded together to facilitate retention of the anchor on the bottom of a water body. Marine vessels and other watercrafts often carry one or more anchors which are used to secure the vessel in a location so that the vessel may hold its position as currents, tides and wind may act to move or pull the vessel in one direction or another. Anchors can have different configurations and different weights and are selected for use based on the size of the vessel or watercraft as well as the nature of the bottom to which the anchor will be set. One typical configuration of an anchor includes a shank with a crown on one end. A fluke and a point or other configuration typically is provided at the crown end for securing the anchor to an underwater bottom surface. The anchor, opposite the crown end, in a typical configuration, has an eye or ring to which a cable, line or chain, generally referred to as the anchor rode, may be attached for lifting the anchor.

The topography of underwater bottoms, such as that of lakes, rivers, seas, and oceans, may all vary. Underwater bottom floor types that may be encountered include sandy bottoms, muddy bottoms, rocky bottoms, and any combinations of these bottoms, as well as natural and man-made structures that may be present on the water bottom. Generally, most typical anchors have one or more flanges, such as metal flukes which are designed to bury themselves in sandy or muddy or soft bottoms. When rocky bottoms are encountered, the anchor fluke will often hook itself to the rock. Depending on the underwater conditions, the entire anchor itself must be changed to adapt to the underwater bottom floor and other conditions.

It still is not uncommon for a marine anchor to become lodged in an underwater obstruction. In order to retrieve a marine anchor from an underwater bottom, generally the anchor rode or line is retracted and must overcome an initial force to dislodge the anchor from its set condition. When the anchor is set a corresponding compass heading that the boat is pointing towards, an anchored position may be determined. For example, if an anchor set is pointing South, when one is attempting to release the set anchor, one would generally follow that heading to back the lodged anchor out. Once the initial set force is overcome, the anchor is pulled up from the water bottom by hoisting the anchor line, and then withdrawn from the water and stowed aboard the vessel. However, this technique may provide enough force to dislodge the anchor and snap or break the anchor line. Then, the entire anchor is lost at the bottom underwater floor.

Many anchors, in spite of the maneuvering efforts that may be made by vessel captains and operators, simply cannot be retrieved once lodged in an obstruction. Therefore, in many instances, there is no choice but to sever the anchor line or cable in order to release the vessel from the anchor. In these instances the anchor remains lodged in the underwater obstruction, which generally is at the bottom of the water environment.

When an anchor becomes stuck and cannot be retrieved, the cost and inconvenience to the vessel owner may be extensive. Often divers retrieve abandoned anchors from underwater locations and resell them. If a vessel operator is an avid boater or operates his craft frequently, there may be more stuck encounters and periodic anchor losses. Though care may be used when anchoring so that an obstruction is attempted to be avoided, many elements, such as strong winds, currents, tides, and sometimes even boat traffic, may make it difficult or impossible at all times to anchor in an obstruction free zone. In addition, where boaters operate their crafts in waters that have rocky bottoms, it may be difficult to avoid potential obstructions.

Current state of the art anchors have many drawbacks. For example, current technologies still fail to offer an economical way to adapt to various underwater conditions without having to store several anchors and changing the entire anchor. Manufacturing costs for providing serval types of anchors may be expensive due to the enormous inventory of different type products that would be needed. In addition, there still remains a need to retrieve the anchor without having the anchor cable or rope breaking or requiring the user to cut it to release the anchor. Cut anchors not only cost the user and create new underwater obstructions, but they also create environmental hazards. The current technology offered today by some of the world's largest companies cannot solve some of the technological issues, and their technologies are not cost-effective. The industry yearns for low cost solutions and a way to limit the number of anchors currently required to be utilized on various underwater floor conditions. Therefore, there still exists a critical need in the art for effective anchor that is self-retrievable, environmentally friendly, and enhanced at a low operating cost.

SUMMARY OF THE INVENTION

Compared to the above prior attempts, the presently disclosed apparatus and methods solve the problems of current state of the art, meets the above requirements, and provides many more benefits. The present disclosure is a unique self-retrievable anchor that provides many benefits. The self-retrievable anchor includes at least a lever, a hinge plate manifold, and a shovel. The lever is attached to a retrieving means selected from a group consisting of a rope, a cable, a chain, a string, a wire, a strap, a tube, and any combination thereof. There are no welds in the present self-retrievable anchor so failure due to weld marks and other welding issues are not a concern. The lever removably connects to the hinge plate manifold that is removably connected to the shovel. The self-retrievable anchor is easily disassembled and assembled providing ease of storage on a boat when not in use.

Because the parts of the self-retrievable anchor disassemble, the shovel portion of the anchor may be easily interchanged to different shapes depending on the underwater floor and conditions. Geometric shape of the shovel, include but are not limited to, a triangle, a square, a rectangle, a circle, polygon, and any combination thereof. All parts of the anchor may be easily replaced if damaged or lost. The parts may be made of a biodegradable material, depending on the implementation, that allows an eco-friendly anchor if a part of the anchor is required to remain on the underwater floor for retrieval of the anchor. The present self-retrievable anchor reduces significantly traditional anchor, chain, and rope loses and saves a lot of money. There is no more guess work or concern as to where the anchor is under the water.

There are many situations when an anchor gets stuck in the sea bottom, maybe due to rocks or wreckages lying on the ocean floor. When that happens most of the time the nylon rope, for example, is the first thing that breaks when pulling to retrieve the stuck anchor because it is the weakest part of the anchoring system. However with the present self-retrievable anchor the weakest part of the system is a fuse pin and not what is connecting the boat to the anchor or retrieving means as in traditional anchor systems. The fuse pin may be oval, or other shapes depending on the implementation. The fuse pin is cost-effective if needed to be replaced after activation and breakage. The fuse pin is calculated to break or fail with a tension force just below the maximum breaking force of the nylon rope, chain, tube, or the like.

For example, depending on a nylon rope diameter which must be proportional to anchor size or weight and to boat size, the fuse pin is calculated to break prior to the nylon rope. An oval fuse pin, for example, has the advantage over round diameter shaped or other traditional shear pins in that the oval fuse pin has more surface area to react to the tensional forces, and hence more subjected to breakage than a round cross-sectional pin. Once the oval fuse pin is broken the anchor's shovel starts to rotate around a pivot hinge pin or cylinder hinge pin's axis and eventually the anchor totally releases from the bottom because it is not hooked anymore. In this implementation the hinge pin does not break and the shovel rotates to assist with removal of the entire self-retrieving anchor.

Depending on the implementation, only the fuse pin may be used and there is no pivot hinge pin. If the fuse pin is broken the lever is then completely removed from the rest of the anchor and the lever is the only portion retrieved. The shovel and hinge plate manifold may be later replaced. Also the remaining parts of the self-retrievable anchor underwater may be biodegradable for eco-friendly purposes.

In yet another implementation, both the fuse pin and pivot hinge pin are breakable. The fuse pin, which may be oval, will break first before the nylon rope or other retrieving means. The shovel will again rotate about the pivot hinge pin. The complete anchor then may be removed from the underwater obstruction. However, if the anchor still cannot be removed and tension forces still increase and the shovel is not released, the pivot hinge pin, which may be round, will break before tension forces break the rope. In this implementation only the lever is then recovered, and the shovel and manifold replaced. In all three implementations, the boat does not require any maneuvering as required in traditional anchors to retrieve a stuck anchor. The self-retrievable anchor of the present invention does not require any maneuvering of the boat during retrieval of this novel anchor, or additional external equipment.

Breakage of the fuse pin, and hinge pin if so used as a breakage pin and if a hinge pin is used at all in the self-retrieving anchor, may be dependent upon the diameters of the pin, geometrical shape, cross-sectional shape, scoring marks, reduction of material in the pins, material strength used for the material in the pin, and any combination thereof. The cross-sectional shape of the fuse pin and the hinge pin may be different or the same depending on the implementation.

A stop bar or retention bar is provided in the self-retrievable anchor and prevents the anchor's shovel to rotate over 180 degrees. This limited rotation of the shovel prevents the shovel from rotating too much and again getting stuck on the bottom. A flat profile or 180 degree profile of the shovel to the level is preferred to ensure removal of the anchor from any obstruction. The oval fuse pin has its shape to offer more cross sectional distance on normal anchoring setting and pull direction from the boat, however when pulling on vertical position the oval pin offers its lowest cross sectional distance calibrated to break at certain force.

One embodiment of utilizing the self-retrievable anchor is as follows. Submerging a self-retrievable anchor under water to a sea or a lake floor, wherein the self-retrievable anchor includes an interchangeable shovel; a hinge plate manifold removably attached to the shovel, the hinge plate manifold defining a slot therebetween, and a first hole and a second hole perpendicular to the slot; a lever having a proximal and distal end, the proximal end defining a third hole and a fourth hole, and the distal end of the lever connected to a retrieving means; the lever disposed within the slot of the hinge plate manifold for the first and the second holes of the hinge plate manifold to align with the third and the fourth holes of the lever, respectively; a fuse pin disposed within the second and the fourth holes; and a pivot hinge pin disposed within the first and the third holes. Attempting to retrieve the self-retrievable anchor from the sea or lake floor. Applying tensional force "F" on the retrieving means by pulling the retrieving means vertically from a boat. Increasing tensional force on the retrieving means, and breaking the fuse pin when ultimate tensile strength of the fuse pin is reached and ultimate tensile strength of the retrieving means is not reached. Rotating the shovel in a 180° position after the fuse pin breaks relative to an original position of the shovel before the fuse pin breaks. And then retrieving the self-retrievable anchor.

Again depending on the implementation the method may further include assembling the self-retrievable anchor each time before submerging under water. It may also involve completely disassembling and storing for re-use the self-retrievable anchor into individual and replaceable parts of the shovel, the hinge plate manifold, and the lever after the anchor is retrieved from under water. As previously discussed, depending on the embodiment, the method may include shearing the pivot hinge pin after the fuse pin is broken and before reaching the ultimate tensile strength of the retrieving means. This embodiment may include retrieving only the lever, and replacing the shovel and the hinge plate manifold at a later time.

The above objects and advantages are met by the present invention. In addition, the above and yet other objects and advantages of the present invention will become apparent from the hereinafter-set forth Brief Description of the Drawings, Detailed Description of the Invention and claims appended herewith. These features and other features are described and shown in the following drawings and detailed description.

BRIEF DESCRIPTION OF THE DRAWINGS

So that those having ordinary skill in the art will have a better understanding of how to make and use the disclosed composition and methods, reference is made to the accompanying figures wherein:

FIG. 1A illustrates a shovel configuration; FIG. 1B illustrates a hinge plate manifold configuration with a fuse pin and pivot hinge pin; and FIG. 1C illustrates a lever;

FIGS. 6B-6D show fuse pin breakage and subsequent shovel rotation up to 180° for removal of the entire self-retrievable anchor, with optional pivot hinge pin breakage or non-use of pivot hinge pin and subsequent optional removal of only the lever.

DETAILED DESCRIPTION

The present disclosure is directed to a self-retrievable anchor. The anchor self-releases from any obstructions under water allowing retrieval of the anchor. Interchangeable parts of the anchor allow easy replacement of a shovel portion for various underwater conditions. Disassembly and reassembly of the anchor allows easy storage on a boat when not in use. The anchor is designed without any welded parts, it has interchangeable parts, and includes an internal breakable pin that acts as a fuse or fuse pin. When a tensional force is applied above the fuse pin's shear strength capacity, the fuse pin breaks making the anchor's shovel portion change from its original position to a rotated position. The position may be a flat shape having the shovel portion of the anchor rotated 180 degrees. A stop bar on the anchor prevents the anchor from rotating completely around 360 degrees because that amount of rotation may further place the anchor back onto the obstruction. This way the anchor is released from where it was stuck at the sea bottom. The fuse pin diameter (d) is calculated according to anchor size and corresponding rope diameter. The fuse pin is not universal and specifically sized to the specific anchor. Preferably the fuse pin is an oval shape cross-sectional diameter as further explained herein. The fuse pin's shear strength limit should be below the breaking strength of the rope.

Typically the rope is the weakest part of the traditional anchoring system (Anchor-Chain-Rope). However in the self-retrievable anchor system, at least the fuse pin is the weakest part. This way the anchoring system can be retrieved completely without any loss of its components. The self-retrievable anchor is designed without any welded parts, and does not have the possibility of welding failure when a weld is subjected to tensional and bending forces. Again, the anchor has interchangeable parts making it capable to change shovel shapes suitable to different sea bottom conditions.

Figure 1A:
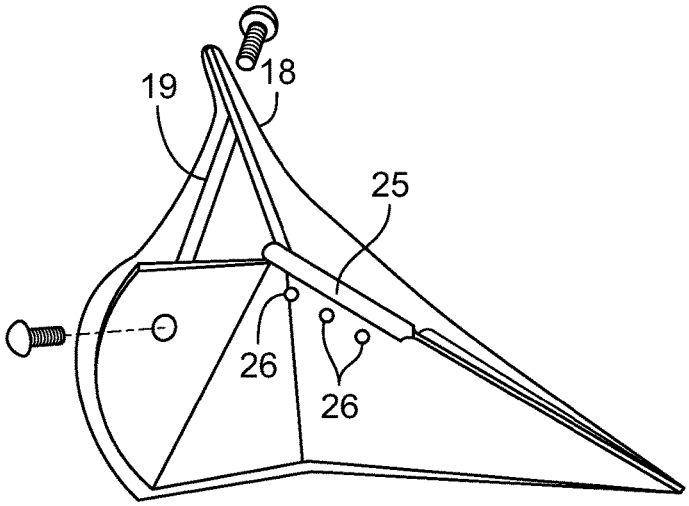
FIGS. 1A-1C are prospective and disassembled views of one embodiment of the self-retrievable anchor.
Figure 1B:
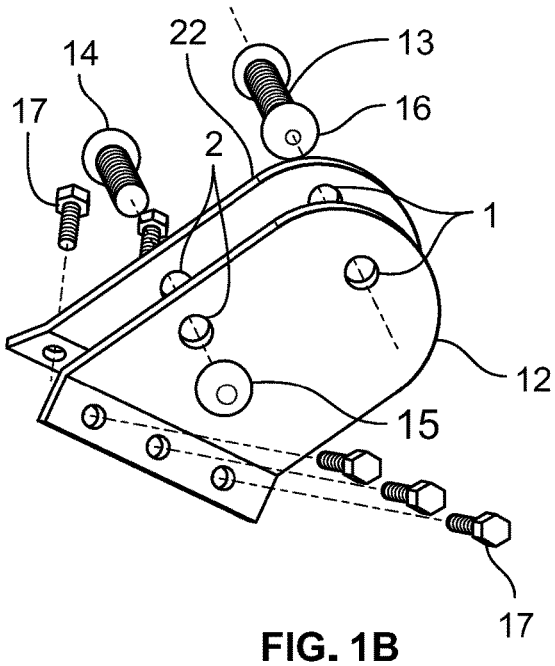
Figure 1C:
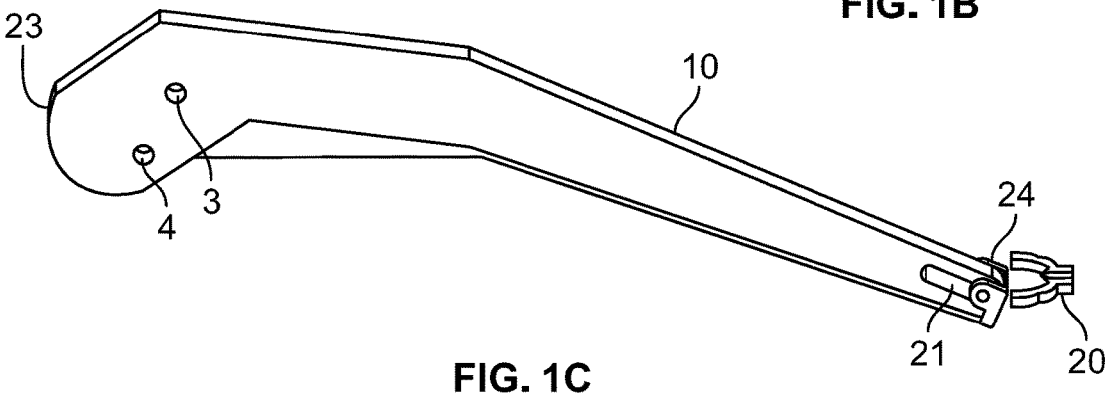

Adverting to the drawings, FIGS. 1A-1C illustrate the self-retrievable anchor disassembled. FIG. 1A shows one embodiment of the shovel 18. The shovel may have various geometric shapes depending on the underwater conditions and the ocean or lake floor. These geometric shapes for shovel 18 include, but are not limited to, a triangle, a square, a rectangle, a polygon, a circle, an oval, and any combination thereof. Because the shovel is interchangeable, various shovels may be easily stored on the boat for easy and quick use when underwater conditions change. The shovel 18 also includes a receiving area 25 for attaching to a hinge plate 12 shown in FIG. 1B. Attachment of the shovel 18 to the manifold 12 may be done by fastener means 17. Fastener means 17 includes, but is not limited to bolts, screws, nuts, washers, rivets, snap-fits, sliding and mating sections, and any other type of fastener that fastens and is removable. The shovel 18 further may define orifices 26 to receive fasteners 17 from the manifold 12. A stop bar or retention bar 19 may also be included in shovel 18. The stop bar 19 may provide addition rigidity to the shovel 18. The stop bar 19 is also utilized as a stop for rotation of the shovel in relation about a hinge pin 13 in FIG. 1B. The stop function of stop bar 19 restricts the rotation of shovel 18 about the hinge pin by contact with the stationary lever 10 shown in FIG. 1C and further explained later herein.

FIG. 1B illustrates one embodiment the hinge pin manifold 12. The manifold has a slot 22 for receiving lever 10. On the side of the manifold are a first hole 1 and a second hole 2 that align with a third hole 3 and a fourth hole 4 of the lever 10, respectively. Preferably hole 1 is centered in a top portion of the manifold for hinge pin 13 to be disposed in and allow rotation of the shove 18. The hinge pin may have a cap 16 to secure the hinge pin 13 in hole 1. Preferably the hinge pin is located higher on the hinge pin plate manifold than the fuse pin to assist in rotation of the shovel. The fuse pin is preferably off center on the hinge pin plate manifold and located lower than the hinge pin and closer to the shovel to provide security and non-rotational movement of the shovel when in normal use.

The fuse pin 14 is disposed in hole 2 prevents rotation of the shovel until the fuse pin is broken. The fuse pin may have a cap 15 to secure the fuse pin. An oval fuse pin has the advantage over round diameter shaped or other traditional shear pins in that the oval fuse pin has more surface area to react to the tensional forces, and hence more subjected to breakage than a round cross-sectional pin. Once the oval fuse pin is broken the anchor's shovel starts to rotate around a pivot hinge pin or cylinder hinge pin's axis and eventually the anchor totally releases from the bottom because it is not hooked anymore to the bottom of the ocean or lake floor. The oval fuse pin has its shape to offer more cross sectional distance on normal anchoring setting and pull direction from the boat, however when pulling on vertical position the oval pin offers its lowest cross sectional distance calibrated to break at certain force.

Depending on the embodiment the hinge plate manifold may just contain a fuse pin. In this embodiment the shovel will not rotate when the fuse pin is broken. Instead the shovel and the hinge plate manifold will disconnect from the lever 10, and only the lever 10 will be recovered. In another embodiment, the only part of the self-retrievable anchor that is made of biodegradable material is the fuse pin 14.

Thus, if fuse pin parts are left at the bottom of the ocean or lake, the self-retrievable anchor system provides an eco-friendly alternative. Also, depending on the embodiment, the self-retrievable anchor system will not create another obstruction as done by traditional anchors in similar situations because of the biodegradability of the shovel and the hinge plate manifold. Bio-degradable materials that may be used for this purpose need to be structurally sound but able to decompose under water if left for a substantial amount of time. Such biodegradable materials include, but are not limited to, bio-degradable composites, biodegradable plastics, soybean plastics, polylactic acid (PLA), linoleum, hemperete, cork, bamboo, untreated timber, mycelium, and the like.

In addition, depending on the implementation, both the fuse pin 13 and the hinge pin 14 may be breakable. In this embodiment, the fuse pin breaks before the hinge pin. If the self-retrievable anchor is stuck on the bottom of the ocean or lake floor, the fuse pin breaks prior to the breaking of the rope or other retrieving means attached to the anchor. If further force "F" on the rope cannot retrieve the anchor even though the shovel has rotated, the hinge pin may break prior to the breaking of the rope. The shovel and hinge plate manifold is left on the bottom but the lever and the chain are retrieved. The fuse pin in this embodiment must have a tensile strength less than the hinge pin. Both the fuse pin and the hinge pin must have a tensile strength less than the rope or other retrieving means.

FIG. 1C illustrates one embodiment of the lever 10. The lever has a distal end 24 and a proximal end 23. The proximal end 23 is inserted into slot 22 when assembling the self-retrievable anchor. The distal end 24 includes a hole 21 for insertion of a retrieving means 20. Retrieving means 20, includes but is not limited to, a rope, a nylon rope, a tube, a strap, a cable, a wire, a string, a chain, a U-bolt, a screw pin anchor, a ring, a keep pin, and any combination thereof.

Depending on the embodiment the lever may also be made of a biodegradable material as the shovel and hinge plate manifold. However, preferably the lever is made of a durable galvanized steel material, mild steel, high-tensile steel, stainless steel, aluminum, or the like. Similarly the shovel and the hinge plate manifold may also be made of the same material as the lever, either biodegradable or not bio-degradable. In addition, the shovel and the hinge plate materials may be the same bio-degradable material and the lever material made of a non-biodegradable material. Additionally, all components may be made of different materials from each other depending on the implementation.

Figure 2:
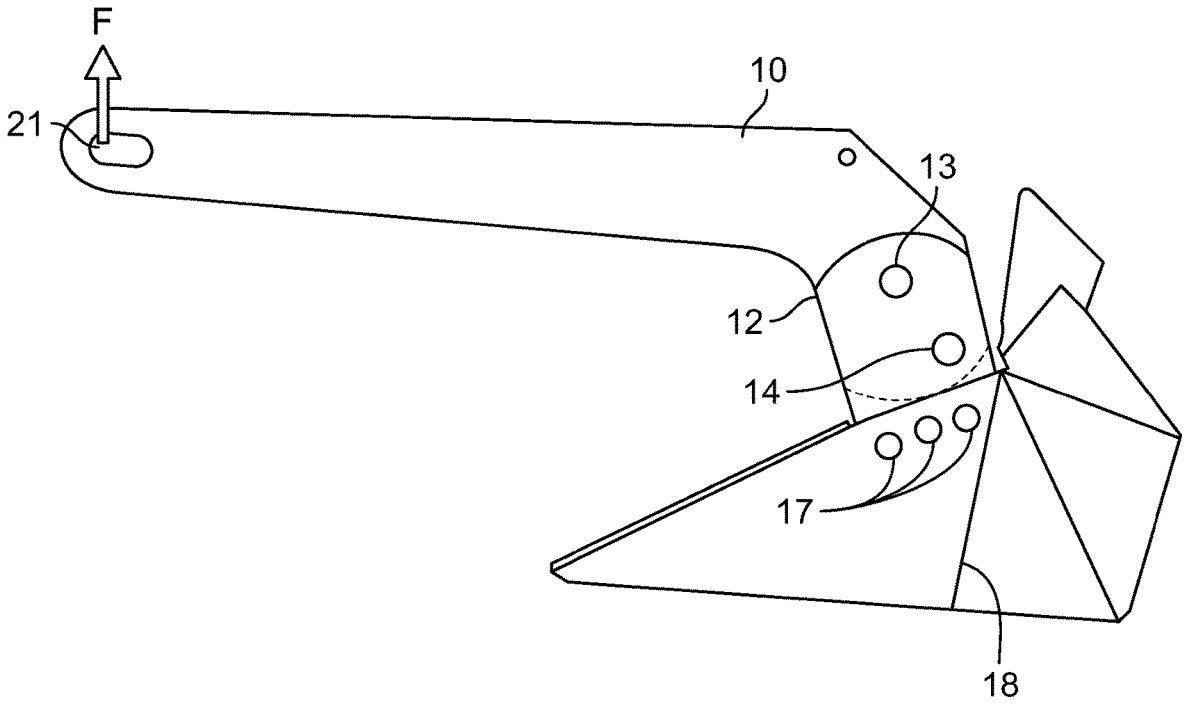
FIG. 2 is a side view of the self-retrievable anchor in FIGS. 1A-1C having the lever hinge plate manifold and shovel assembled.

FIG. 2 illustrates one embodiment of the self-retrievable anchor fully assembled. Shown is shovel 18 attached to the hinge plate manifold 12 by fastening means 17. In this embodiment, the lever 10 is attached to the hinge plate manifold 12 by a pivot hinge pin or hinge pin 13 and a fuse pin 14. Again, depending on the implementation the anchor may just contain a fuse pin, or have both the hinge pin and the fuse pin breakable. In these embodiments the lever itself would be retrieved and the shovel would not rotate.

In the preferred placement, the pivot hinge pin is above the fuse pin 14 so that if the fuse pin breaks due to an obstruction on the anchor when trying to retrieve, then the shovel will rotate above the pivot hinge pin 13. During normal operation, a tension force "F" is applied by the retrieving means 20 at a location 21 on the lever 10. The force "F" is typically perpendicular to the lever 10 as the anchor is attempted to be pulled back into the boat. If force "F" is nearing the tensile strength of the retrieving means, or nylon rope, the fuse pin 14 will break forcing the shovel 18 to rotate counterclockwise about the pivot hinge pin 13.

Figure 3:
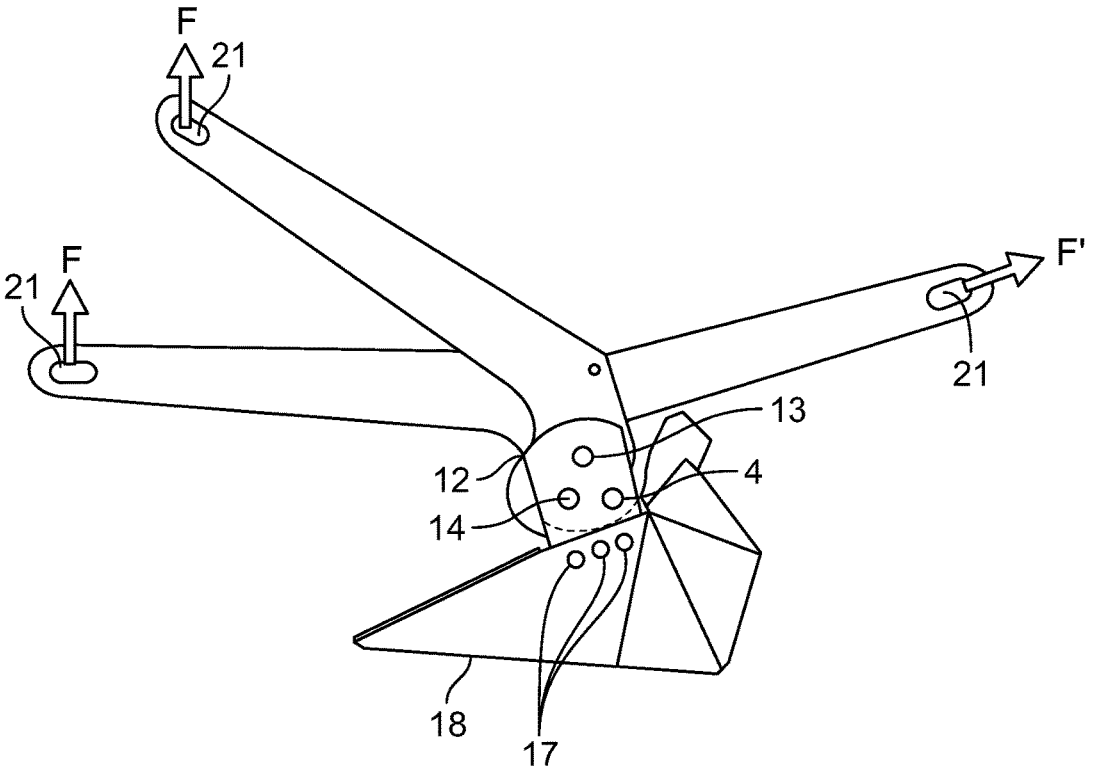
FIG. 3 illustrates one embodiment of the fuse pin breakage, and how traditional movement of the boat to alleviate a fouled an anchor would not assist in removing the self-retrievable anchor.

FIG. 3 further illustrates the fuse pin breakage. Shown is a tensional force "F" pulling vertically from a boat. Further force beyond the tensile strength of the fuse will break the fuse pin 14 causing the shovel to rotate as shown in Figure s 6A-6D. The tensile strength of the fuse pin is matched to what the ultimate tensile strength of the nylon rope or other retrieving means is used. Also shown in FIG. 3, is a comparison of traditional means of releasing a stuck anchor. As previously discussed, the boat may try to maneuver in a position to pull the anchor from the obstruction.

However, as shown if a force "F'" is applied and the lever rotates instead of the shovel, then the shovel's position and orientation on the ocean or lake floor will not change. Using the self-retrievable anchor such boat maneuvering is not needed. The shovel will rotate around the hinge pin and release the anchor. Rotation of the lever does not change the orientation of the shovel. Changing orientation of the shovel, or rotation of the shovel as done by the self-retrievable anchor is important to release the anchor from an obstruction.

Figure 4:
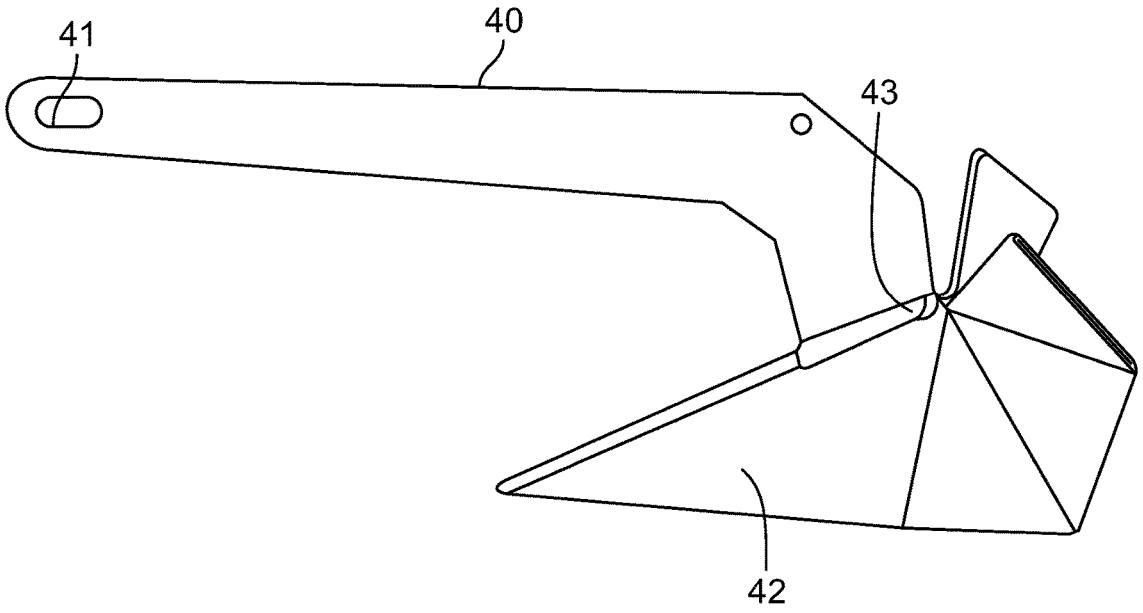
FIG. 4 (Prior Art)
FIG. 4 illustrates a side view of a prior art welded anchor.

FIG. 4 illustrates an anchor of the prior art. Shown is an anchor having a shank 40, a fluke 42 for capturing the bottom of the ocean or lake, and an eyelet 41 for connection to a chain or rope. The shank is typically welded to the fluke at connection 43. The weld is susceptible to weld failures and other mechanical failures breaking apart the anchor. Also the prior art anchor because of the weld does not allow rotation of the fluke portion.

Prior art anchors does not have the ability to interchange components. Typically a boat may carry two or more different types of anchors to adapt to the underwater conditions. However, with the self-retrievable anchor, parts are interchangeable allowing the shovel portion to be changed to easily adapt to various underwater conditions.

Figure 5:
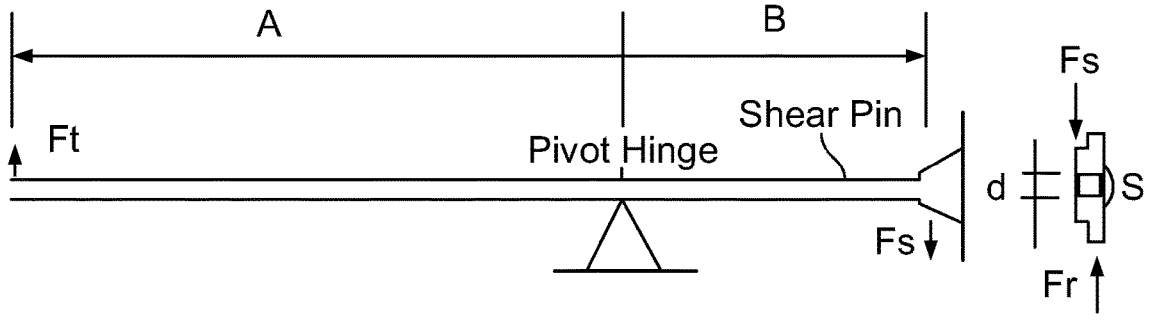
FIG. 5 illustrates an engineering diagram simulating one embodiment of involved forces acting on the self-retrievable anchor.

FIG. 5 illustrates an engineering diagram simulating the involved forces acting on the self-retrievable anchor. In FIG. 5, the following abbreviations are used: Ft=Tensional Force of the rope, Fs=Shear Force at shear or "Fuse Pin", Fr=Resultant opposing Force at Anchor's body, A=Anchor's lever length or Distance from where the rope is connected to the pivot hinge, B=Distance from "Pivot Hinge" to shear point or "Fuse Pin", S=Maximum Shear stress of the "Fuse Pin" material, and d=Fuse Pin Diameter.

The sum of all forces perpendicular to the hinge point or pivot hinge and momentums is assumed to be equal to zero. Thus the calculation of the diameter of the fuse pin is calculated based on variable that include the lever length, tension force of the rope, distance between the pivot pin and fuse pin, and other variables as shown below:

So: $(Ft \times A)-(Fs \times B)=0$ or $FtA=FsB$ ①

The Shear Stress Formula is: $S=Fs/A$ ②

Where A=Cross sectional area of the "Fuse Pin"

In terms of Pin diameter $A=\pi r^2$ $r=d/2$ Therefore $A=\pi^2/4$ ③

Then: $Fs=S\pi d^2/4$ ④

Substituting formula 4 into 1 $FtA=BS\pi d^2/4$ finding for "d" which is the unknown value Then $d^2=4FtA/BS\pi$ and finally: $d=\sqrt{4FtA/BS\pi}$ Thus, the fuse pin is not universal, and the fuse pin diameter is calculated based upon the tensional force of the rope (or an amount, such as 10% below the rope's ultimate tensile strength), the Anchor's lever length or Distance from where the rope is connected to the pivot hinge, Distance from "Pivot Hinge" to shear point or "Fuse Pin", and Maximum Shear stress of the "Fuse Pin" material.

Again the fuse pin may be of an oval shape, or other shape for benefits previously articulated. The oval or wider portion would be in the horizontal position of the anchor and the thinner section of the oval fuse pin would be in the vertical direction of the "F" force being pulled from the boat. Depending on the implementation, the above diameter should be for this thinner portion of the oval shaped fuse pin. Furthermore, depending on the embodiment the fuse pin may not be oval shape in the cross-sectional directional, but may be another shape, including but not limited to a circle, a orthogon, a hexagon, a triangle, or other polygon shape depending on the implementation of the anchor.

Again depending on the embodiment, the hinge pin's diameter is less than that of the chain link diameter in the cross sectional direction for the chain connecting the anchor to the boat. The reasons for this smaller diameter of the hinge pin is in order to retrieve at least all of the chain and the anchor's shank. This scenario is used in case the fuse does not shear at all. This embodiment for the hinge pin may be utilized for other shaped fuse pins as well.

Figure 6A:
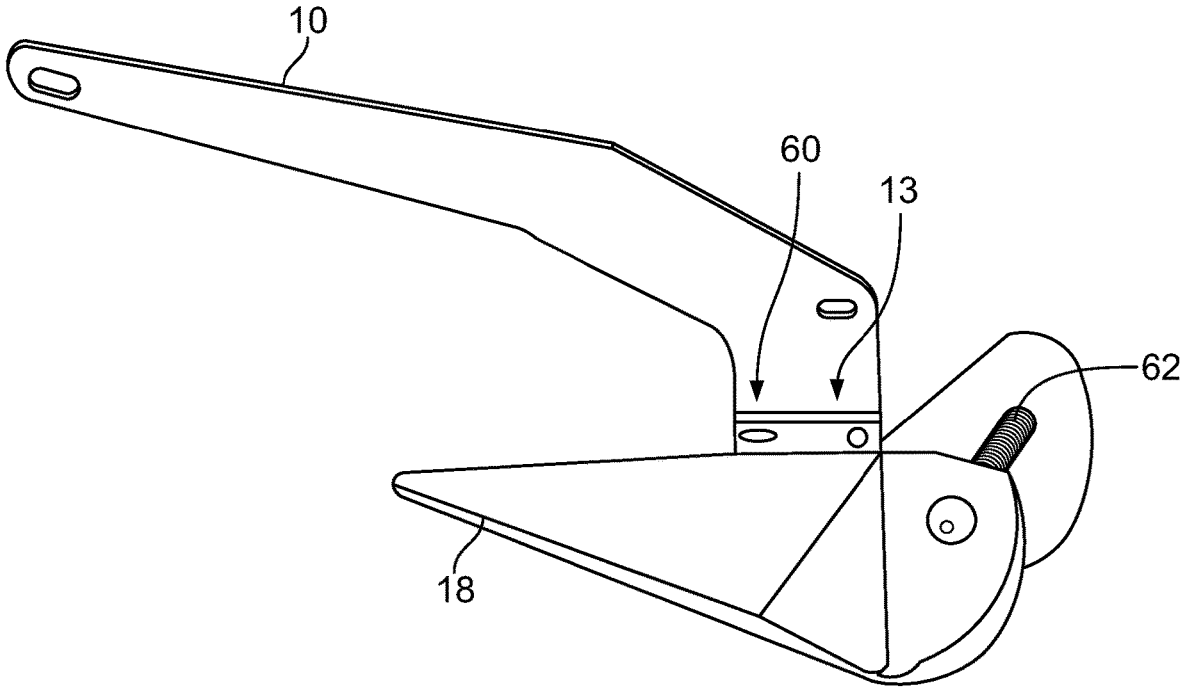
FIGS. 6A-6D illustrates the self-retrievable anchor with a fuse pin and pivot hinge pin in FIG. 6A.

FIGS. 6A-6D illustrate various embodiments of the self-retrievable anchor. Shown in FIG. 6A is a self-retrievable anchor having a lever 10. As previously discussed, the lever is connected to a retrieving means such as, but not limited to, a nylon rope. Depending on the implementation, a fuse pin 60 with fuse pin hole 61 in lever 10 may be located a distance away from the pivot hinge pin 13 and in the same plane in the hinge plate manifold. An additional eyelet 3 may be incorporated into the lever depending on the embodiment that can assist in hanging up the lever during storage.=. A stop bar 62 is located between the right and left shovel 18 in this embodiment.

Figure 6B:
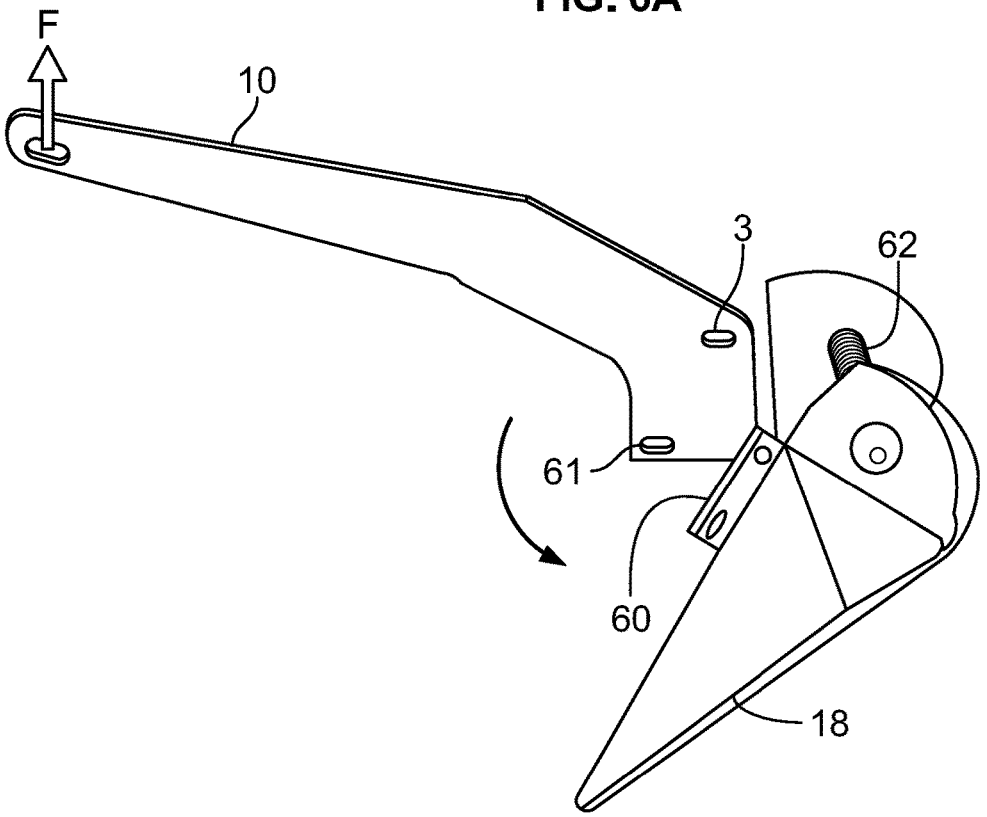

FIG. 6B illustrates the counterclockwise rotation of the shovel 18 when the fuse pin is broken. Again, the fuse pin breaks when force "F", from the pulling of the nylon rope from the boat, exceeds the tensile strength of the fuse pin. The tensile strength of the fuse pin is specifically designed to be below the ultimate tensile strength of the nylon rope or other retrieving means.

Figure 6C:
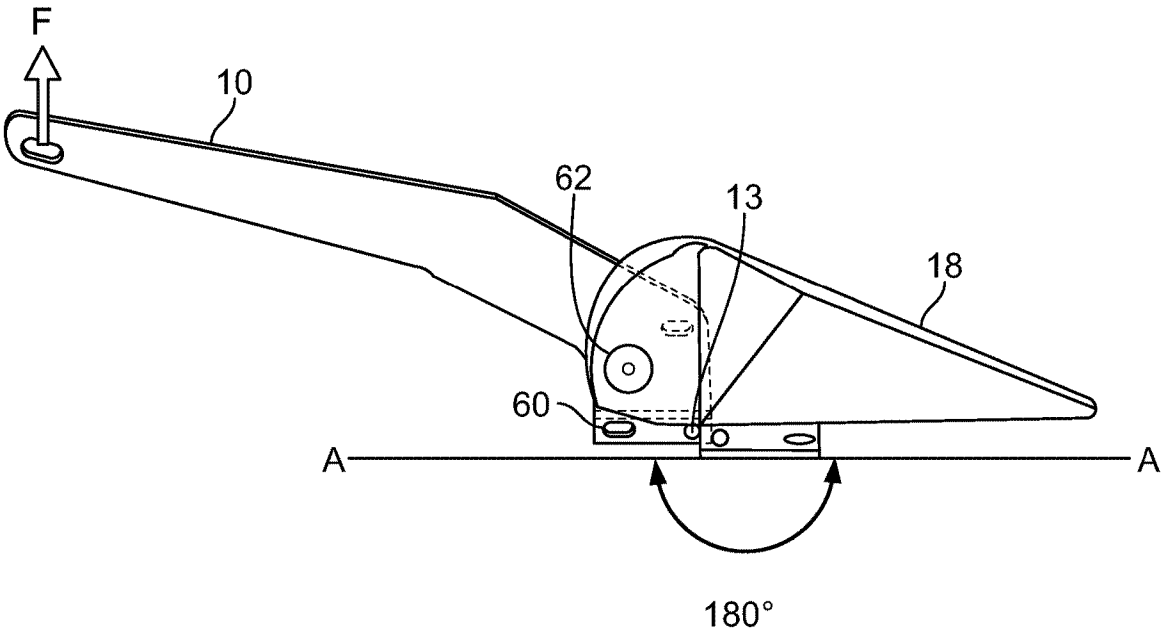

Continual force in the perpendicular direction from a user on the boat will rotate the shovel up to a 180 degree position along axis A-A as shown in FIG. 6C. Again the stop bar 62 prevents further rotation of the shovel beyond 180 degrees. The restricted rotation of the shovel is to prevent reintroduction of the shovel to the same underwater obstruction or a different obstruction underwater furthering hampering the retrieval of the anchor. A portion of the broken fuse pin may remain in lever 10 or fall off.

Hinge pin 13 is the pivot point that the shovel 18 will rotate about in a counterclockwise direction. The self-retrievable anchor is then entirely recovered after the shovel of the self-retrievable anchor "self-removes" itself from the underwater obstruction. The fuse pin can later be replaced and is economically cost effective to replace as compared to traditional systems or other systems that require replacements of the entire anchor because of a cut or broken line to the anchor.

Depending on the implementation the fuse pin may be made of a biodegradable material as previously described so that any portion of the fuse pin that remains under water will be eco-friendly and not disturb the underwater environment or create a new underwater obstruction as traditional cut anchors typically do when boat owners are force to leave it underwater.

Figure 6D:
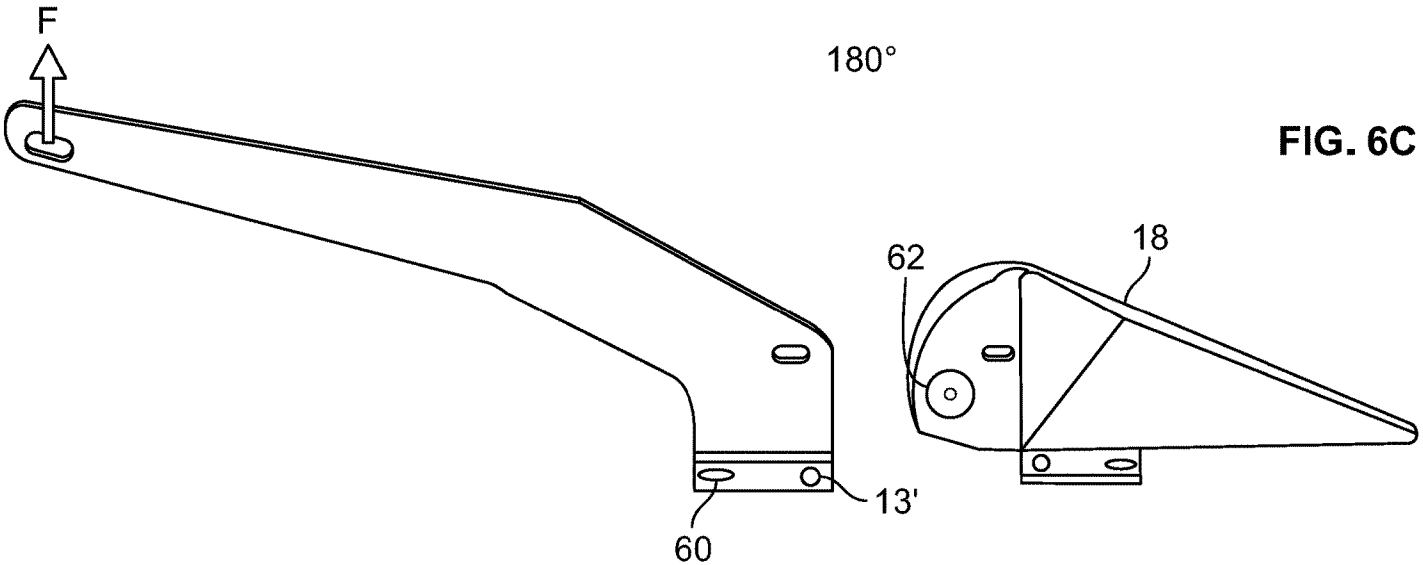

FIG. 6D further shows other embodiments that include where the hinge pin is also breakable but the lever, the chain and the rope are retrieved. In one embodiment, the fuse pin 60 breaks prior to the breaking of the nylon rope or other retrieving means. If rotation of the shovel does not accomplish release of the anchor and the anchor continues to be stuck even when the force "F" is further increased, then a breakable hinge pin 13' will break prior to reaching the breaking tensile strength of the nylon rope.

The tensile strength of the breakable hinge pin will be higher than the fuse pin so that the fuse pin will break first to rotate the shovel. The hinge pin's tensile strength will in this embodiment be below the tensile strength of the nylon rope used. The lever 10 will be retrieved plus the rope and chain and the other parts of the self-retrievable anchor will remain underwater. Again, depending on the embodiment, the biodegradability of the remaining parts, if so implemented, creates an eco-friendly environment, and does not create further obstructions underwater, unlike traditional or other anchors. In a further embodiment for FIG. 6D, no hinge pin is utilized and only the fuse pin is used. In this embodiment, if the force "F" exceeds the tensile strength of the fuse pin the fuse pin will break before the nylon rope breaks. For this embodiment where there is no hinge pin, the shovel will not necessarily rotate and the lever 10 will be retrieved. Parts of the self-retrievable anchor left under water are later replaced.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claims is:

1. A self-retrievable anchor, comprising:

an anchor having an interchangeable shovel with a geometric shape that provides for resistance to movement of the interchangeable shovel when submerged under water;

a hinge plate manifold removably attached interchangeable to the shovel, the hinge plate manifold defining a slot therebetween, and a first hole and a second hole perpendicular to the slot;

a lever having a proximal end and distal end, the lever at the proximal end defining a third hole and a fourth hole, and the distal end connected to a retrieving means;

the lever disposed within the slot of the hinge plate manifold for the first and the second holes of the hinge plate manifold to align with the third and the fourth holes of the lever, respectively;

a fuse pin disposed within the second and the fourth holes, and a pivot hinge pin disposed within the first and the third holes;

wherein the fuse pin is individually sized dependent upon the anchor to break before reaching ultimate tensile strength of the retrieving means attached to the lever, and the fuse pin is not universal to the anchor; and wherein the interchangeable shovel is in a rotated 180° position after the fuse pin breaks relative to an original position interchangeable of the shovel before the fuse pin breaks for providing self-retrieval of the anchor.

2. The self-retrievable anchor of claim 1, wherein the self-retrievable anchor further includes an attachment means for attaching the hinge plate manifold to the interchangeable shovel to provide no welds between the hinge plate manifold, the interchangeable shovel, and the lever for increased strength as compared to a welded anchor.

3. The self-retrievable anchor of claim 1, wherein the geometric shape of the interchangeable shovel is interchangeable for adaption to sea or lake floor substrate, and the fuse pin is an oval shape.

4. The self-retrievable anchor of claim 3, wherein the geometric shape of the interchangeable shovel is selected from a group consisting of a triangle, a square, a rectangle, a circle, polygon, and any combination thereof; and the cross-sectional shape of the fuse pin is oval for increased sensitivity to tension forces given from the retrieving means as compared to a round cross-sectional pin.

5. The self-retrievable anchor of claim 1, wherein the anchor is stored completely disassembled in individual and replaceable parts of the interchangeable shovel, the hinge plate manifold, and the lever before the anchor is submerged under water, and after the anchor is retrieved from under water.

6. The self-retrievable anchor of claim 1, wherein the interchangeable shovel further includes a stop bar for limiting rotation of the interchangeable shovel after the fuse pin breaks.

7. The self-retrievable anchor of claim 1, wherein the pivot hinge pin has a higher ultimate tensile strength than the fuse pin and a lower ultimate tensile strength than the retrieving means for the pivot hinge pin to shear after the fuse pin and leave the interchangeable shovel and hinge plate manifold on a sea or lake floor if the interchangeable shovel can not be retrieved after the fuse pin breaks.

8. The self-retrievable anchor of claim 7, wherein only the lever is retrieved.

9. The self-retrievable anchor of claim 1, wherein the retrieving means is selected from a group consisting of a rope, a cable, a chain, a string, a wire, a strap, a tube, and any combination thereof.

10. The self-retrievable anchor of claim 1, wherein the fuse pin is made of a biodegradable material for providing an eco-friendly anchor if remaining on a sea or a lake floor after retrieving the anchor.

11. A method of using a self-retrievable anchor, comprises:

submerging a self-retrievable anchor under water to a sea or a lake floor, wherein the self-retrievable anchor includes:

an interchangeable shovel; a hinge plate manifold removably attached to the interchangeable shovel, the hinge plate manifold defining a slot therebetween, and a first hole and a second hole perpendicular to the slot; a lever having a proximal and distal end, the proximal end defining a third hole and a fourth hole, and the distal end of the lever connected to a retrieving means; the lever disposed within the slot of the hinge plate manifold for the first and the second holes of the hinge plate manifold to align with the third and the fourth holes of the lever, respectively; a fuse pin disposed within the second and the fourth holes; and a pivot hinge pin disposed within the first and the third holes;

attempting to retrieve the self-retrievable anchor from the sea or lake floor;

applying tensional force on the retrieving means by pulling the retrieving means vertically from a boat;

increasing tensional force on the retrieving means, and breaking the fuse pin when ultimate tensile strength of the fuse pin is reached and ultimate tensile strength of the retrieving means is not reached;

rotating the interchangeable shovel in a 180° position after the fuse pin breaks relative to an original position of the interchangeable shovel before the fuse pin breaks; and retrieving the self-retrievable anchor.

12. The method of claim 11, further including replacing the interchangeable shovel based on the type of ocean or lake floor substrate.

13. The method of claim 12, further including replacing the fuse pin to individually size the fuse pin dependent upon the interchangeable shovel so that the fuse pin breaks before reaching ultimate tensile strength of the retrieving means attached to the lever or the pivot hinge pin, and the fuse pin has an oval cross-sectional shape, and the pivot hinge pin has a round cross-sectional shape.

14. The method of claim 11, further including assembling the self-retrievable anchor each time before submerging under water.

15. The method of claim 14, further includes completely disassembling and storing for re-use the self-retrievable anchor into individual and replaceable parts of the interchangeable shovel, the hinge plate manifold, and the lever after the anchor is retrieved from under water.

16. The method of claim 11, further including shearing the pivot hinge pin after the fuse pin is broken and before reaching the ultimate tensile strength of the retrieving means.

17. The method of claim 16, further including retrieving only the lever, and replacing the interchangeable shovel and the hinge plate manifold.

18. A self-retrievable anchor, comprising:

an interchangeable shovel, a lever, and a hinge plate manifold that contains no welds therebetween for eliminating welding failure when a weld is subjected to tensional and bending forces during anchor retrieval;

the lever attached to a retrieving means and the lever disposed within the manifold, and the manifold removably attached to the interchangeable shovel;

the lever further attached to the manifold by at least a fuse pin that has a specific dimension depending on an anchor size so that when a tensional force is applied by the retrieving means above fuse pin shear strength capacity, and below breaking strength of the retrieving means, the fuse pin breaks forcing the interchangeable shovel to rotate 180° from an original position of the interchangeable shovel; and wherein the self-retrievable anchor is released when stuck at a sea or a lake floor bottom.

19. The self-retrievable anchor in claim 18, wherein the interchangeable shovel, the lever, and the hinge plate manifold are replaceable and interchangeable parts that are changed to suit different sea or lake bottom conditions.

20. The self-retrievable anchor of claim 18, further includes a hinge pin attaching the lever to the hinge plate manifold, the hinge pin has an ultimate tensile strength greater than the fuse pin and less than the retrieving means so that the lever detaches from the interchangeable shovel if the interchangeable shovel cannot be retrieved after the fuse pin breaks.

* * * * *